US010337228B1

(12) United States Patent
Matthews

(10) Patent No.: US 10,337,228 B1
(45) Date of Patent: Jul. 2, 2019

(54) SWINGING POCKET DOOR

(71) Applicant: Dan A Matthews, Raleigh, NC (US)

(72) Inventor: Dan A Matthews, Raleigh, NC (US)

( * ) Notice: Subject to any disclaimer, the term of this patent is extended or adjusted under 35 U.S.C. 154(b) by 149 days.

(21) Appl. No.: 15/694,944

(22) Filed: Sep. 4, 2017

(51) Int. Cl.
*E06B 3/50* (2006.01)
*E05D 15/58* (2006.01)
*E05D 15/06* (2006.01)

(52) U.S. Cl.
CPC ..... *E05D 15/58* (2013.01); *E05D 15/0604* (2013.01); *E06B 3/5072* (2013.01); *E06B 3/5081* (2013.01); *E05Y 2900/512* (2013.01)

(58) Field of Classification Search
CPC ..... E05D 15/48; E05D 15/58; E05D 15/0604; E05D 2015/485; E06B 3/50; E06B 3/5072; E06B 3/5081; E05Y 2900/512
See application file for complete search history.

(56) References Cited

U.S. PATENT DOCUMENTS 704,887 A * 7/1902 Low ..... E05F 17/00 160/181
961,726 A 6/1910 Mayr
2,565,383 A 8/1951 Linebaugh
2,584,874 A 2/1952 Haas
2,936,206 A * 5/1960 Wilmer ..... E05D 15/58 109/70
3,266,189 A * 8/1966 Eby ..... E06B 3/4654 49/152
3,464,159 A * 9/1969 Hewitt ..... E06B 3/4618 49/177
3,707,014 A 12/1972 Kolvusale
4,438,594 A * 3/1984 Bunzl ..... E05D 15/58 49/125
4,589,463 A 5/1986 Ryan
5,832,980 A * 11/1998 Cianciolo ..... E05D 15/58 160/197
6,170,195 B1 * 1/2001 Lim ..... E05D 15/58 49/141
6,422,287 B1 * 7/2002 Wilke ..... E05D 15/58 160/195
6,823,927 B2 9/2004 Steel et al.
7,950,439 B2 * 5/2011 Anderson ..... E05D 15/58 160/195
8,443,549 B2 * 5/2013 Salvietti ..... E05D 15/48 49/118
8,756,865 B2 * 6/2014 Nicholson ..... E05D 15/58 49/142
9,353,561 B2 5/2016 Gaenzle
2010/0242366 A1 * 9/2010 Liebscher ..... E05D 15/58 49/142
2012/0073205 A1 * 3/2012 Hamaker ..... E06B 3/5072 49/163

(Continued)

*Primary Examiner* — Justin B Rephann
(74) *Attorney, Agent, or Firm* — Peter Loffler

(57) ABSTRACT

A dual function door acts as both a pocket door and a hinged swinging door. A first door panel is hingedly attached to a wall for swinging. A first header rail is attached to the top of the first door panel while a second header rail is attached to an appropriate surface at the same height as the first header rail. A second door panel has rollers that slide within the first header rail. The first door panel is positionable so that the first header rail and the second header rail align allowing the second door panel to also slide within the second header rail. The two header rails can be locked in the aligned position.

10 Claims, 6 Drawing Sheets

(56) References Cited

U.S. PATENT DOCUMENTS

| | | | | |
|---|---|---|---|---|
| 2012/0255230 | A1* | 10/2012 | Smith | E05D 15/48 49/257 |
| 2016/0010377 | A1* | 1/2016 | Lim | E06B 3/481 49/65 |
| 2017/0204644 | A1* | 7/2017 | McMullen, Jr. | E05D 15/58 |

* cited by examiner

SWINGING POCKET DOOR

BACKGROUND OF THE INVENTION

1. Field of the Invention

The present invention relates to a door system that functions as both a rolling pocket door to partition off one space as well as a hinged swing door to partition off a second space.

2. Background of the Prior Art

Recreational vehicles or RVs are very popular. An RV allows its occupants to travel long distances and take in the countryside. At the end of the driving day, the RV is pulled into an appropriately suited campground (or even a parking lot or driveway if need be), and the RV serves as the nightly hotel complete with kitchen, toilet, and shower facilities, all with the added bonus of not needing to unpack. Modern RVs run anywhere from the simple to the luxurious and drive with relative ease, having power steering, power brakes, and automatic transmissions, so that most drivers can master piloting an RV down the highway with little effort. Most jurisdictions do not require a separate endorsement on a person's driver's license to pilot the RV. If the RV comes equipped with a diesel engine, fuel efficiency tends to be reasonable considering the size of the RV.

While modern RVs have many state of the art modern luxuries, such as a refrigerator, air conditioning when the engine is not running, satellite television, etc., there is one feature of the RV that even modern technology is ill suited to advance, that being space. As the RV is a road vehicle, it has strict limits on width, length, and height, so that even the most modern and advanced RV's have a very finite amount of living space available. Although many RVs have slide outs to increase the overall living space, slide outs have their limits too.

Irrespective of the particular design of an RV, living space is at a premium and RV designers got to great lengths to maximize the functionality of every square inch of space within the RV in order to maximize the effective usable space, thereby increasing the overall satisfaction with the RV by the user. Such features include items that can sink into the floor, ceiling, or into otherwise into or against empty wall space when not in use, stovetops that can flip and become counter or table space when the cooking is complete, and sofas that become beds. While individually, each of these and other features many not save much space on their own, collectively, they can make the difference between an RV that feels cramped and one that feels open and spacious.

One floor space saving area that has been essentially overlooked is the internal doors within the RV. In a class A RV, at least two and possibly more doors are needed. At least one door is needed for the toilet closet and another door is needed to the master bedroom of the RV so as to give the users of the master bedroom privacy from others who may be sleeping or occupying the remainder of the RV. If one of these two doors can be eliminated without loss of functionality, then several square feet of space can be saved, increasing the overall living space for the occupants.

What is needed is a system that allows the elimination of one of the two doors that provides privacy to a toilet closet and main bedroom within an RV while still allowing occupants of each space to be afforded needed privacy. Such a system must be easy to use and maintain.

SUMMARY OF THE INVENTION

The swinging pocket door of the present invention addresses the aforementioned needs in the art by providing a single door system that closes off either a toilet closet (or other space where privacy or partition is desired (a closet, for example)), and a bedroom (or other room) so as to save space and allow the space that would be occupied by the second door to be used as a living space. The swinging pocket door is of relatively simple design and construction, being produced using standard manufacturing techniques, so as to be relatively inexpensive to produce so as to make the system economically attractive to potential consumers of this type of device. Installation of the swinging pocket door is straightforward as is its usage by the RV occupants. Each door operates in its respective standard fashion.

The swinging pocket door of the present invention is comprised of a first door panel that has a first top and an opposing a first bottom, a first side and an opposing second side, a first surface and an opposing second surface. The first door panel is hingedly attached to a wall surface of an enclosure (which includes any appropriate vertical structure that allows the first door panel to swing) along the first side of the first door panel. A first header rail has a first end and a second end and is attached to the first surface of the first door panel, along the first top thereof. A second header rail has a third end and a fourth end and is attached to a surface of the enclosure such that the first header rail and the second header rail are disposed at the same height. A second door panel has a second top and has a roller assembly that extends upwardly from the second top. The roller assembly has at least one roller. The first door panel is rotatable between a first position wherein the second end of the first header rail faces (and possibly touches) the third end of the second header rail and the first header rail and the second header rail longitudinally align, and a second position wherein the first header rail and the second header rail do not align. When the first door panel is in the first position, the second door panel is able to slide between the first header rail and the second header rail via the roller that rolls within the first header rail and the second header rail—if the two header rails do not touch, they are sufficiently close to one another to allow smooth transition of the roller rolling between the two header rails. A rail lock is attached to the first header rail for locking the first header rail with the second header rail in the longitudinally aligned position whenever the first door panel is in the first position. A door lock attached to the second door panel for holding the second door panel in a fixed position. A rail stop is located within the first header rail, proximate the first end thereof, such that the roller assembly cannot roll past the rail stop. A handle is located on the to second door panel.

BRIEF DESCRIPTION OF THE DRAWINGS

Similar reference numerals refer to similar parts throughout the several views of the drawings.

DESCRIPTION OF THE PREFERRED EMBODIMENT

Figure 1:
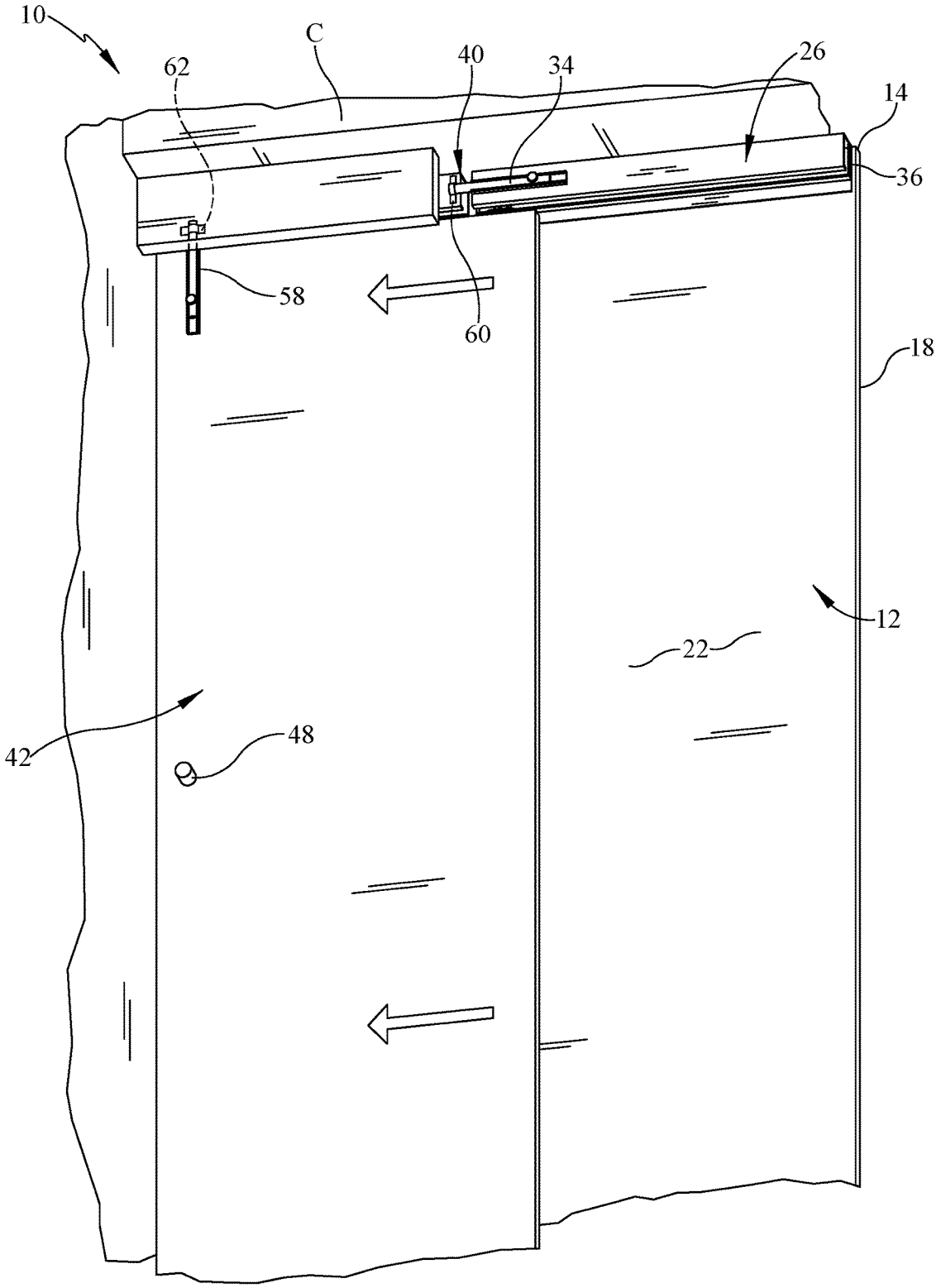
FIG. 1 is an environmental view of the swinging pocketed door of the present invention installed within a recreational vehicle, the swinging pocket door being used as a pocket door.
Figure 2:
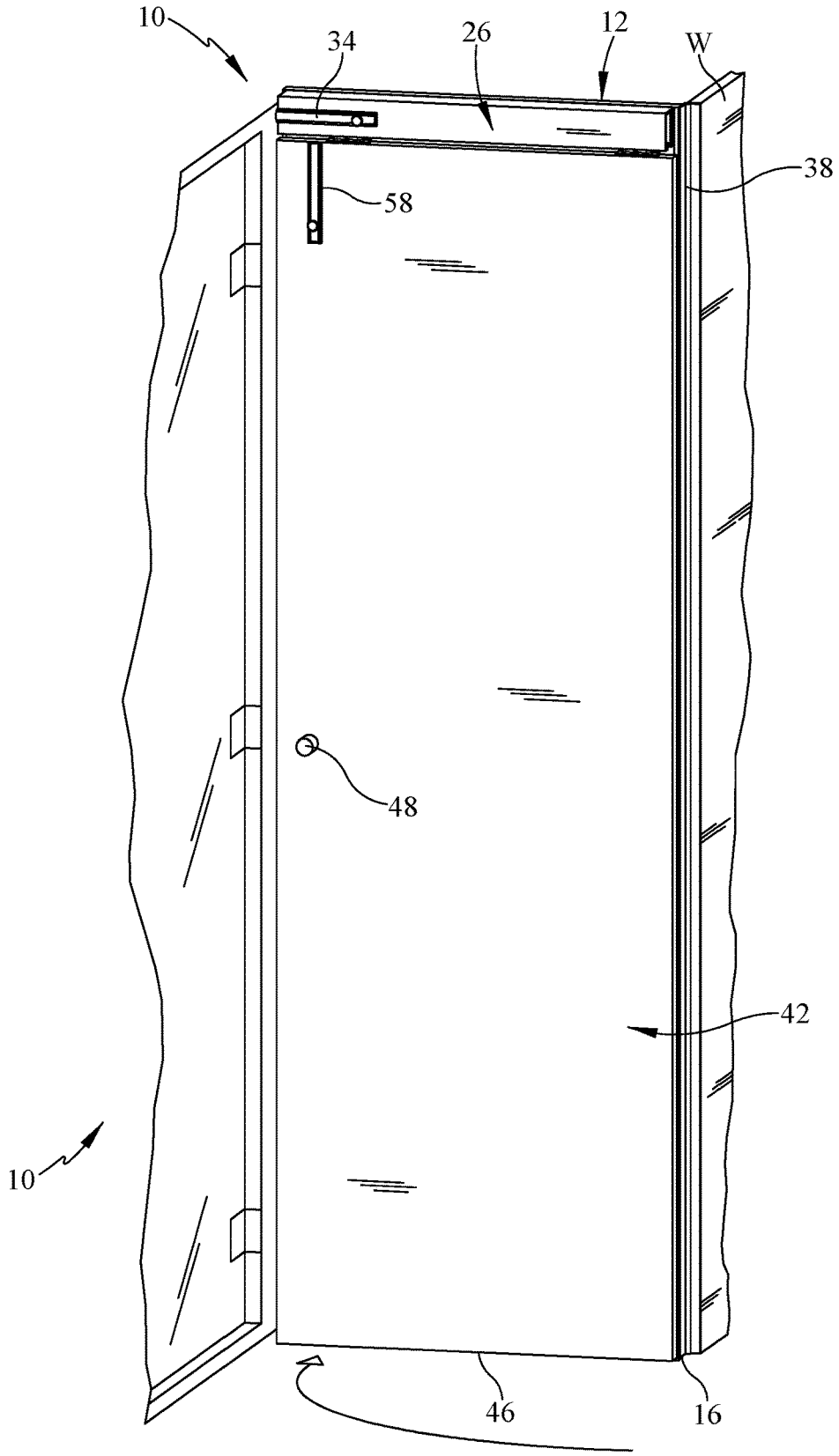
FIG. 2 is an environmental view of the swinging pocketed door installed within a recreational vehicle, the swinging pocket door being used as a swinging door.
Figure 3:
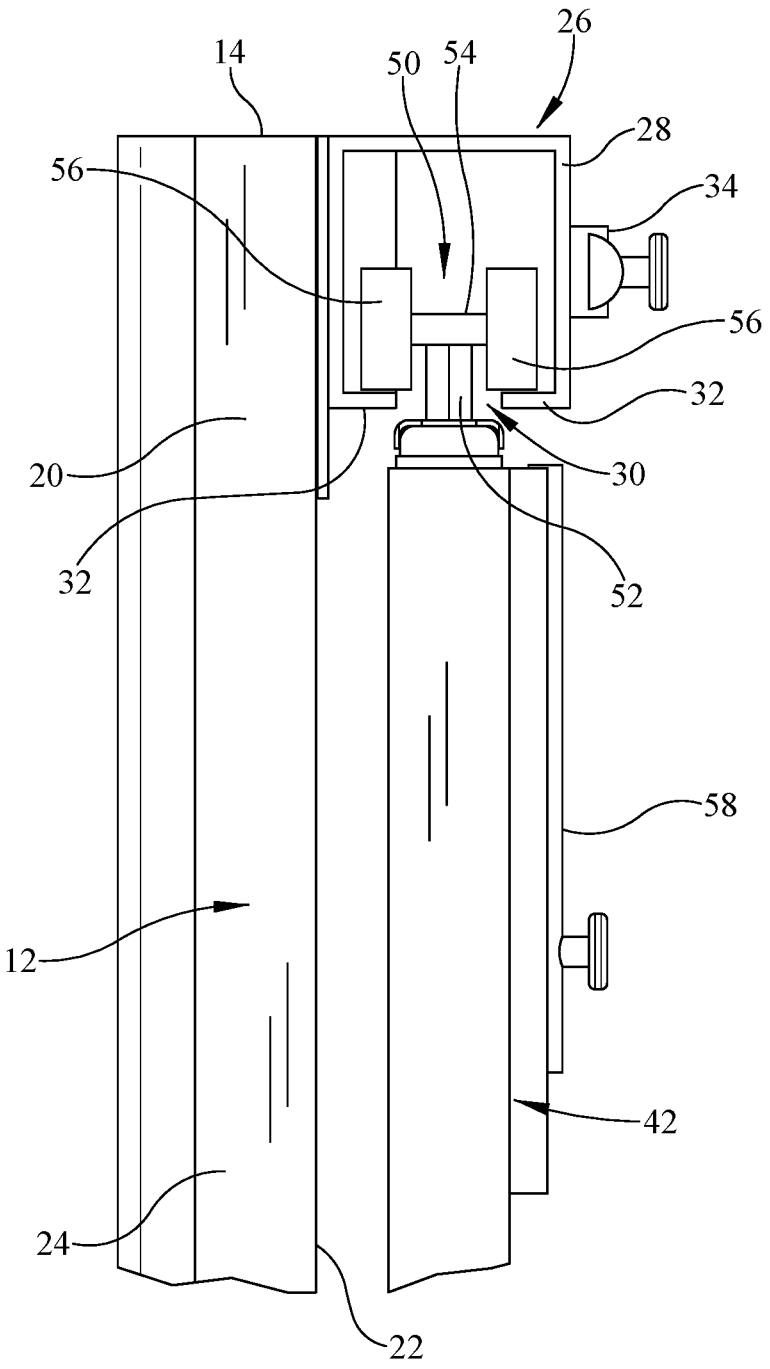
FIG. 3 is an end view of a portion of the swinging pocket door illustrating the head rail.
Figure 4:
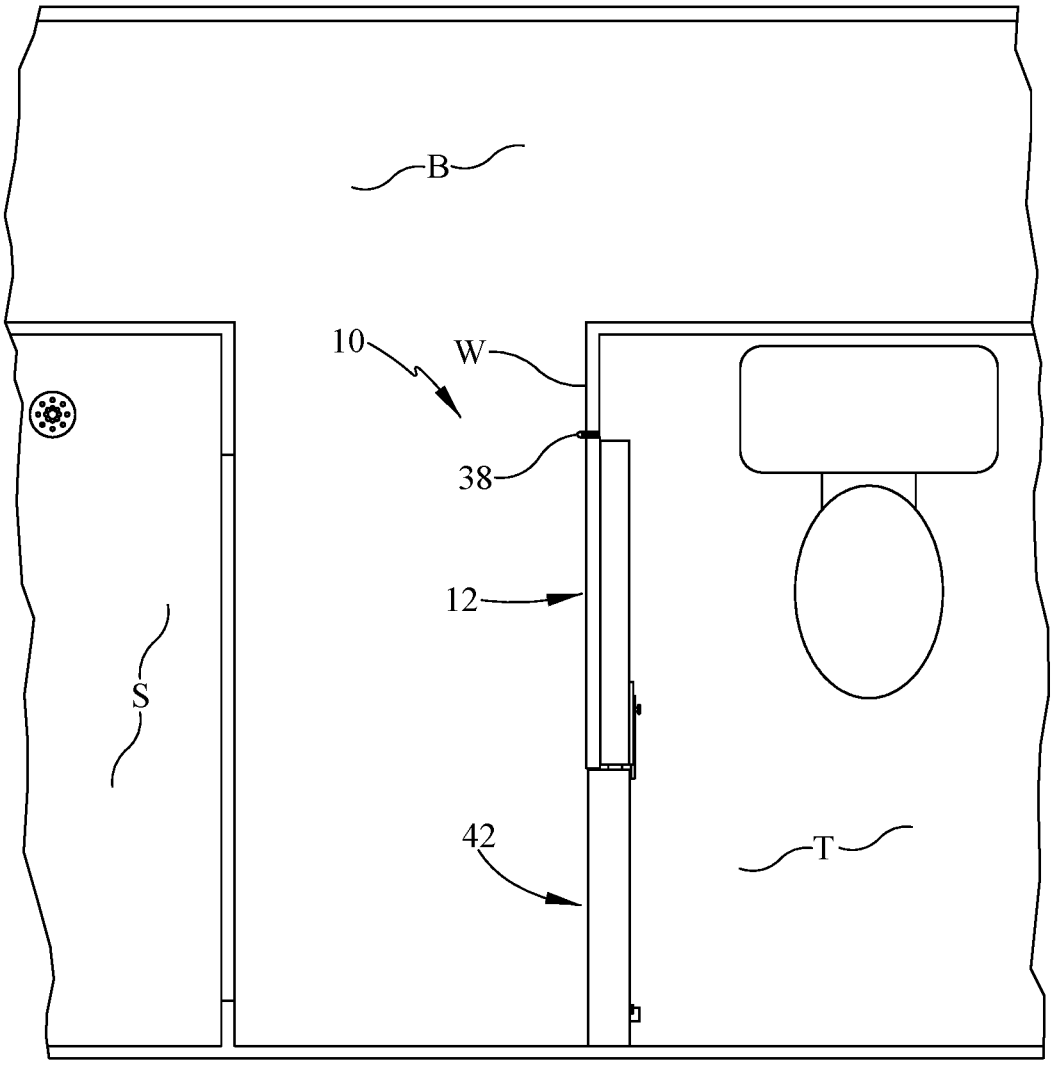
FIG. 4 is a top plan view of the swinging pocket door being used as a pocket door.

Referring now to the drawings, it is seen that the swinging pocket door of the present invention, generally denoted by reference numeral 10, is comprised of a first door panel 12 that has a first top 14, a first bottom 16, a first side 18, a second side 20, a first surface 22, and a second surface 24. Attached to the first side 18 of the first door panel 12, along the first top 14 thereof, is a first header rail 26. As seen, the first header rail 26 is an elongate tubular member 28 that has a downwardly facing central slot 30 so that ramps 32 are located on either side of the slot 30. A rail lock 34 is located on an external surface of the tubular member 28 proximate the second side 20 of the first door panel 12. A rail stop 36 may be located within the tubular member 28 proximate first side 18 of the first door panel 12. The tubular member 28 is attached to the first door panel 12 in any appropriate fashion such as via adhesion, welding if the materials are appropriate, screws, rivets, etc.

The first door panel 12 is hingedly attached to an appropriate wall or other appropriate structure W via hinges 38 that are attached in appropriate fashion to the second surface 24 of the first door panel 12 along the first side 18 thereof and to an exterior surface of the wall W.

A second header rail 40 is attached to an appropriate surface of the vehicle, namely the ceiling C, so that the second header rail 40, which is substantially similar in structure to the first header rail 26, other than lacking a rail stop, is at the same height as the first header rail 26.

A second door panel 42 has a second top 44 and a second bottom 46. One or more handles 48 may be located on the second door panel 42. Attached to the second top 44 of the second door panel 42 is one or more roller assemblies 50 (typically two such assemblies 50 are used for standard sized door panels), which include a stem 52 extending upwardly from the second top 44. A transverse head 54 is located on the end of the stem 52 and a pair of rollers 56 are rotatably located on the end of the head 54, on either side thereof. A door lock 58 may be located on the second door panel 42.

Figure 5:
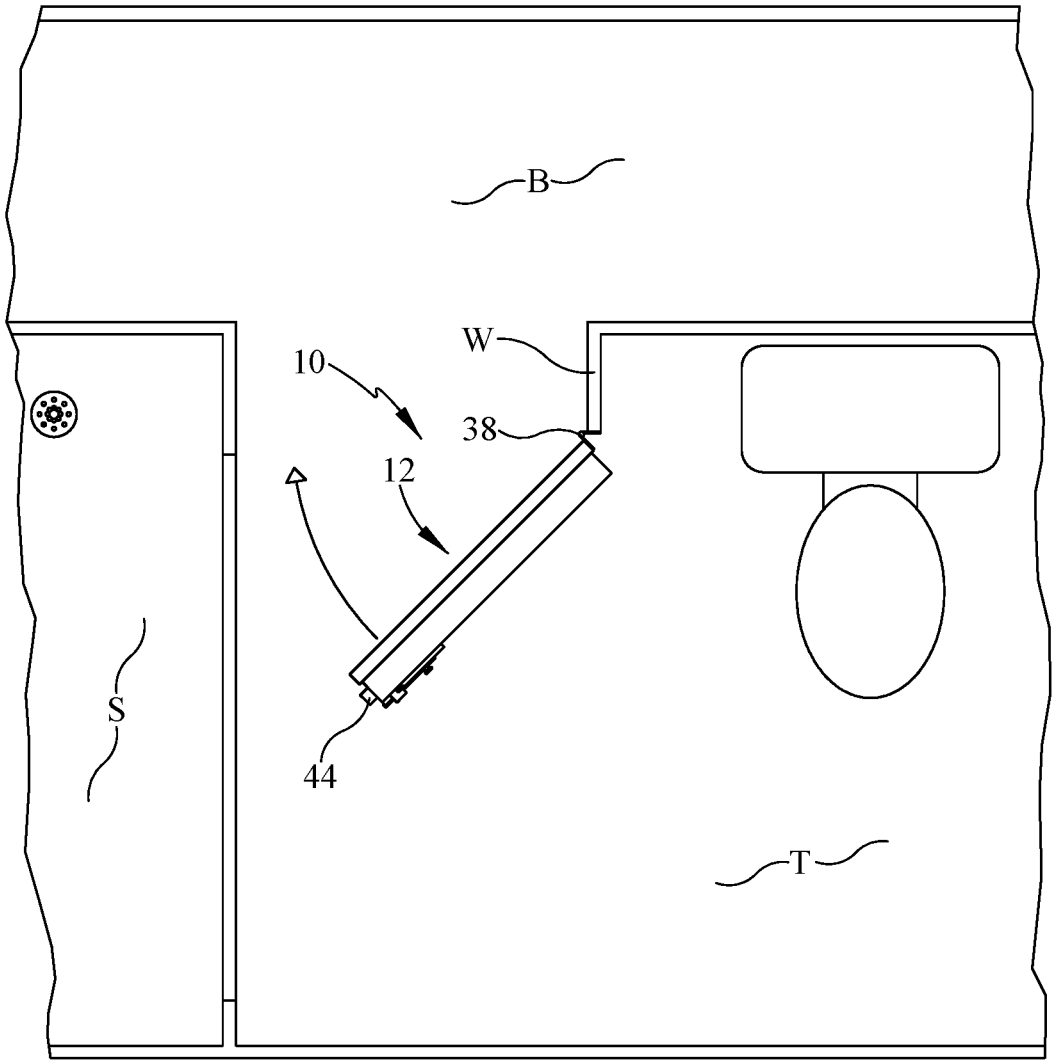
FIG. 5 is a top plan view of the swinging pocket door being used as a swinging door, the door partially closed.
Figure 6:
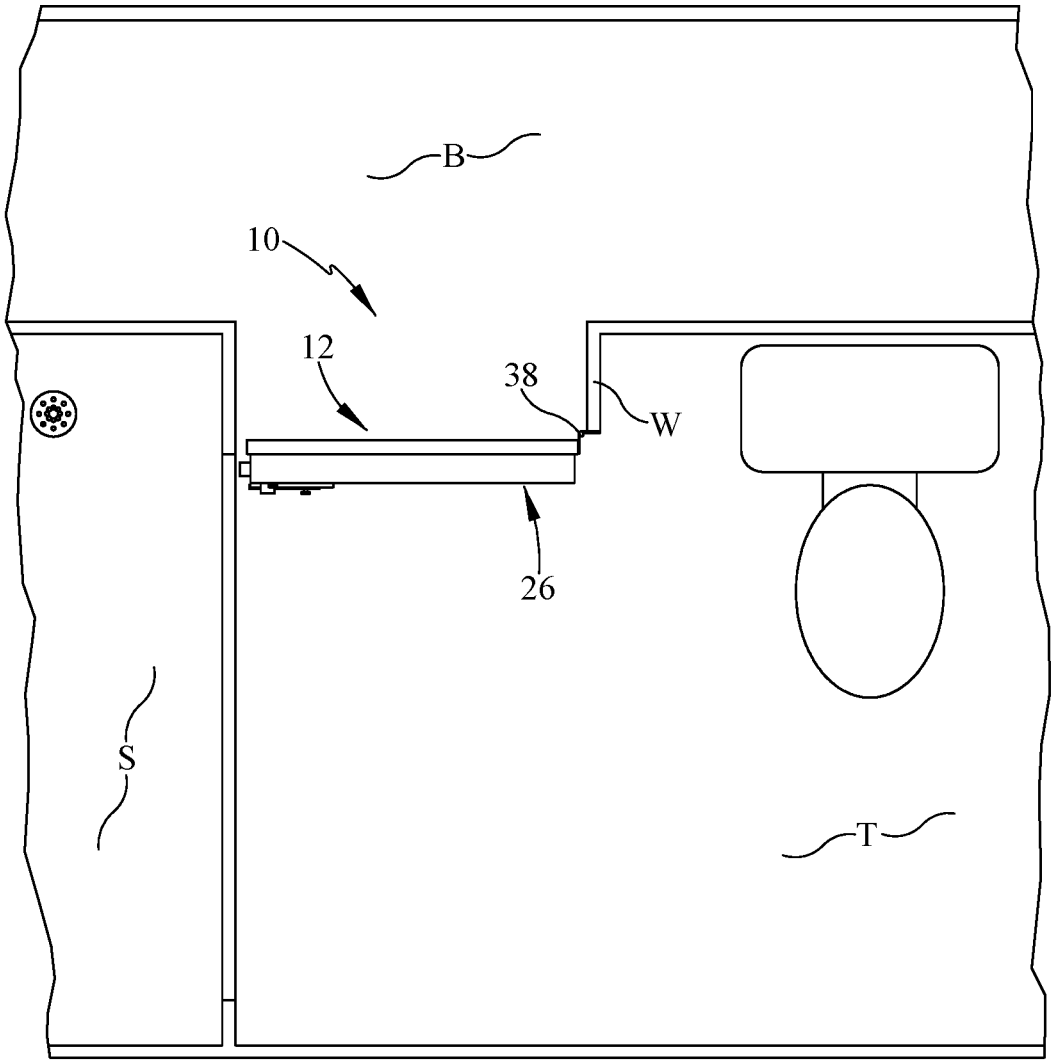
FIG. 6 is a top plan view of the swinging pocket door being used as a swinging door, the door fully closed.

In order to use the swinging pocket door 10 of the present invention, the first door panel 12 is hingedly attached to the wall W, as previously described. The second door panel 42 is positioned so that its roller assemblies 50 are positioned so that the head 54 and rollers 56 are disposed within the first header rail 26 attached to the first door panel 12 with the stem passing downwardly through the central slot 30. The rollers 56 sit on the ramps 32 of the tubular member 28 so that the second door panel 42 is suspended from the first header rail 26 in typical pocket door fashion. With the second door panel 42 positioned as far back as possible so as to abut the rail stop 36 (if used), and the second door panel 42 essentially overlays the first door panel 12, the swinging pocket door 10 is capable of swinging about the hinges 38, as best seen in FIGS. 5 and 6. When the swinging pocket door 10 is fully swung closed and partitioning the room B beyond the toilet closet T and shower S, a stop (not illustrated) may be provided to prevent over rotation of the swinging pocket door 10 and the door lock 58 may be engaged with its catch (not illustrated) in order to hold the swinging pocket door 10 in this closed as a swinging door position, as seen in FIG. 6. The second door panel is prevented from exiting the first header rail 26 by the rail stop 36. The room B being partitioned can be accessed or exited by swinging the swinging pocket door 10 open and closed as desired. In order to close off the toilet closet T, the swinging pocket door 10 is swung to its open position as a swinging door. In this position, the first header rail 26 and the second header rail 40 longitudinally align, allowing the second door panel 42 to roll along, via its roller assemblies 50, the first header rail 26 and aligned second header rail 40. In order to maintain the first header rail 26 and the second header rail aligned, the rail lock 34 on the first header rail 26 is slid into its catch 60 located on the second header rail 40. It is expressly recognized that other types of locks can be employed including spring-loaded button locks, magnetic holding of the first header rail 26 to the second header rail 40, etc. When the second door panel 42 is fully extended relative to the first door panel 12 so that the swinging pocket door 10 is closed as a pocket door, the door lock 58 may be inserted into its catch 62 in order to hold the swinging pocket door 10 in this closed as a pocket door position. Of course the door lock 58 may be horizontally disposed and can be any appropriate door lock. Advantageously, the second door panel 42 is dimensioned so that one of its roller assemblies 50 remains within the first header rail 26 whenever the swinging pocket door 10 is fully closed as a pocket door.

The swinging pocket door 10 can also be used in order tight quarters, such as on a boat, an aircraft, etc.

While the invention has been particularly shown and described with reference to an embodiment thereof it will be appreciated by those skilled in the art that various changes in form and detail may be made without departing from the spirit and scope of the invention.

I claim:

1. A dual function door comprising:

a first door panel having a first top and an opposing a first bottom, a first side and an opposing second side, a first surface and an opposing second surface, the first door panel adapted to be hingedly attached to a wall surface of an enclosure along the first side of the first door panel;

a first header rail having a first end and a second end, the first header rail attached to the first surface of the first door panel, along the first top thereof, a second header rail having a third end and a fourth end, the second header rail adapted to be attached to a surface of the enclosure such that the first header rail and the second header rail are disposed at the same height;

a second door panel having a second top, the second door panel having a roller assembly extending upwardly from the second top, the roller assembly having a roller; and wherein the first door panel is rotatable between a first position wherein the second end of the first header rail faces the third end of the second header rail and the first header rail and the second header rail longitudinally align, and a second position wherein the first header rail and the second header rail do not align, and such that when the first door panel is in the first position, the second door panel is able to slide between the first header rail and the second header rail via the roller that rolls within the first header rail and the second header rail.

2. The dual function door as in claim 1 further comprising a lock attached to the first header rail such that the lock locks the first header rail and the second header rail in the longitudinally aligned position whenever the first door panel is in the first position.

3. The dual function door as in claim 1 further comprising a lock attached to the second door panel for holding the second door panel in a non-movable position.

4. The dual function door as in claim 1 further comprising a rail stop disposed within the first header rail proximate the first end thereof such that the roller assembly is not able to roll past the rail stop.

5. The dual function door as in claim 1 further comprising a handle located on the second door panel.

6. A dual function door comprising:

a first door panel having a first top and an opposing a first bottom, a first side and an opposing second side, a first surface and an opposing second surface, the first door panel adapted to be hingedly attached to a wall surface of an enclosure along the first side of the first door panel via a hinge that is attached to the wall surface and to the second surface of the first door panel proximate the first side;

a first header rail having a first end and a second end, the first header rail attached to the first surface of the first door panel, along the first top thereof, a second header rail having a third end and a fourth end, the second header rail adapted to be attached to a surface of the enclosure such that the first header rail and the second header rail are disposed at the same height;

a second door panel having a second top, the second door panel having a roller assembly extending upwardly from the second top, the roller assembly having a roller; and wherein the first door panel is rotatable between a first position wherein the second end of the first header rail faces the third end of the second header rail and the first header rail and the second header rail longitudinally align, and a second position wherein the first header rail and the second header rail do not align, and such that when the first door panel is in the first position, the second door panel is able to slide between the first header rail and the second header rail via the roller that rolls within the first header rail and the second header rail.

7. The dual function door as in claim 6 further comprising a lock attached to the first header rail such that the lock locks the first header rail and the second header rail in the longitudinally aligned position whenever the first door panel is in the first position.

8. The dual function door as in claim 6 further comprising a lock attached to the second door panel for holding the second door panel in a non-movable position.

9. The dual function door as in claim 6 further comprising a rail stop disposed within the first header rail proximate the first end thereof such that the roller assembly is not able to roll past the rail stop.

10. The dual function door as in claim 6 further comprising a handle located on the second door panel.

* * * * *